United States Patent [19]

Terashima

[11] Patent Number: 4,834,646

[45] Date of Patent: May 30, 1989

[54] PROCESS FOR COOLING FIRED PRODUCTS IN A KILN

[75] Inventor: Tomonari Terashima, Nagoya City, Japan

[73] Assignee: NGK Insulators, Ltd., Japan

[21] Appl. No.: 185,362

[22] Filed: Apr. 19, 1988

Related U.S. Application Data

[63] Continuation of Ser. No. 19,579, Feb. 27, 1987, abandoned.

[30] Foreign Application Priority Data

Mar. 22, 1986 [JP] Japan ..... 61-64314

[51] Int. Cl.[4] ..... F27D 7/00; F27B 9/00

[52] U.S. Cl. ..... 432/4; 432/48; 432/144; 432/145; 432/152

[58] Field of Search ..... 432/78, 137, 141, 144, 432/145, 149, 152, 173, 5, 4, 48

[56] References Cited

U.S. PATENT DOCUMENTS

| | | | |
|---|---|---|---|
| 3,168,298 | 2/1965 | Cook et al. | 432/145 |
| 3,172,647 | 3/1965 | Remmey | 432/145 |
| 4,030,879 | 6/1977 | Stanasila et al. | 432/144 |
| 4,249,895 | 2/1981 | Mantegani | 432/145 |
| 4,285,669 | 8/1981 | Walchutter | 432/145 |
| 4,527,974 | 7/1985 | Carraroli et al. | 432/145 |
| 4,573,909 | 3/1986 | Scanlon | 432/152 |
| 4,588,378 | 5/1986 | Yamamoto et al. | 432/144 |

*Primary Examiner*—Henry C. Yuen

*Attorney, Agent, or Firm*—Arnold, White & Durkee

[57] ABSTRACT

A process is provided for cooling fired products such as tiles in a kiln by repeating a cooling step to cool down said products, the cooling step comprising blowing a cooling gaseous fluid, e.g., cooling air, to the fired products in the kiln, alternately with a non-cooling step to moderate a sharp temperature gradient between the surfaces and the interior regions of the products, the non-cooling step comprising stopping or suppressing the blowing of cooling gaseous fluid between cooling steps. The process of the invention can achieve rapid cooling without giving rise to dunting due to thermal stresses and thus can increase the productivity of kilns. When the invention is applied to a tunnel kiln, the kiln can be considerably shortened.

2 Claims, 2 Drawing Sheets

PROCESS FOR COOLING FIRED PRODUCTS IN A KILN

This is a continuation of application Ser. No. 019,579, filed Feb. 27, 1987, now abandoned.

BACKGROUND OF THE INVENTION

1. Field of the Invention

The present invention relates to a process for cooling hot fired products in a kiln, which enables products such as tiles or the like to be rapidly and safely cooled after being fired in a kiln such as a tunnel kiln or a periodic kiln.

2. Description of the Prior Art

For example, in a tunnel kiln for the firing tiles, cooling of fired products as they travel is usually effected by uniformly blowing a cooling gaseous fluid to hot fired products on trucks, from cooling nozzles arranged on the side, etc. of a cooling zone. However, it has been found that when a drastic cooling or quenching is effected to hasten the cooling, only the surfaces of the fired products are quenched rapidly, forming a sharp temperature gradient between the central portion and surfaces of the fired products making the products liable to fracture, i.e., so-called , due to dunting the thermal stresses. The cooling rate has therefore a limit, and accordingly conventional tunnel kilns have had to be provided with a relatively long cooling zone conjoined with a firing zone, for example, cooling zones as long as 40–50% of the entire length of the kiln, so that a heating schedule has been required such that trucks advance slowly, taking about 20 hours to pass through a kiln of an entire length reaching 50–100 m. Further, in the case of periodic kilns since rapid cooling is not permitted, fired products have to be retained in the kiln for a long period of time, so that the kilns generally have an extremely low productivity.

SUMMARY OF THE INVENTION

The present invention has been directed toward obviating problems as described above. conventional cooling processes have been involved and accordingly an object of the invention is to provide a process for cooling hot fired products in a kiln, wherein the fired products can be cooled more quickly than in conventional processes, without giving rise to dunting.

The process according to the present invention is characterized by repeating a cooling step in which cooling gaseous fluid to is blown on the fired products in the kiln, alternately with a non-cooling step to moderate or relax the temperature gradient in the fired products, the non-cooling step comprising stopping or reducing the blowing of the cooling gaseous fluid between cooling steps.

In accordance with the present invention the temperature gradient formed between the surfaces and the interior regions of the fired products is moderated or relaxed by conducting between cooling steps, a non-cooling step in which the blowing of the cooling gaseous fluid is stopped or reduced. Thermal spalling i.e. fracture due to thermal stresses is prevented even in a subseqent more drastic cooling step by the processes of this invention.

BRIEF DESCRIPTION OF THE DRAWING

The preferred embodiments of the invention will now be described in more detail by way of example with reference to the accompanying drawings in which.

DESCRIPTION OF THE PREFERRED EMBODIMENT

Figure 1:
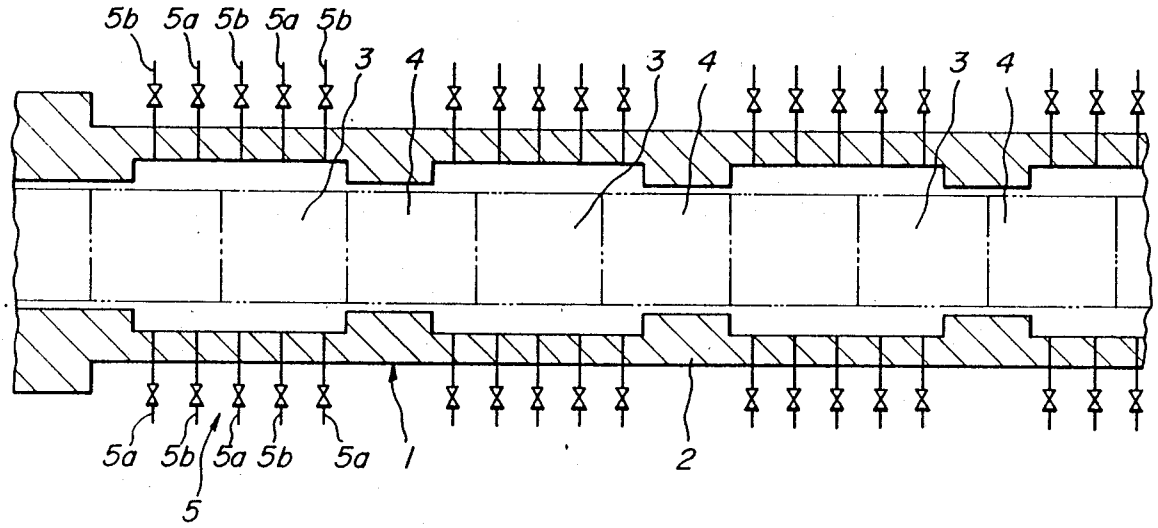
FIG. 1 is a horizontal, longitudinal sectional view of a tunnel kiln for carrying out processes of the invention.
Figure 2:
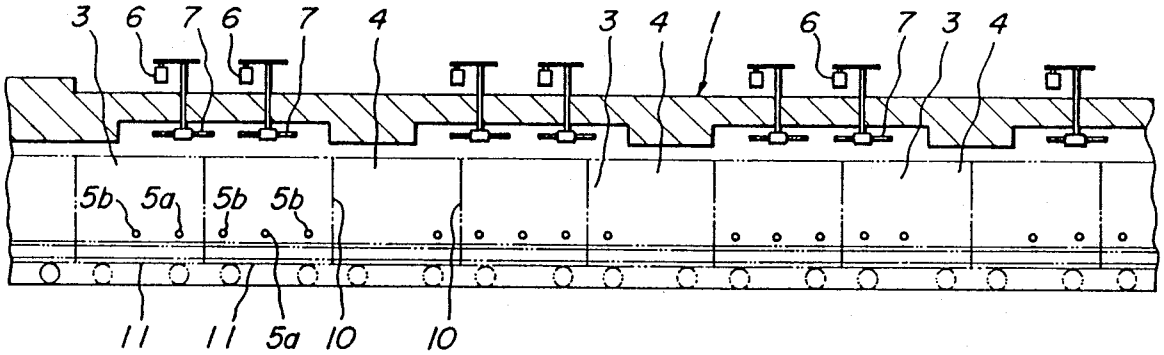
FIG. 2 is a vertical, longitudinal sectional view of the kiln shown in FIG. 1.

In FIGS. 1 and 2, which are horizontal and vertical sectional views respectively illustrating a cooling zone in a tunnel kilnl, trucks 11 loaded with fired products 10 coming out of a firing zone (not shown) proceed through the cooling zone to the right. In the cooling zone defined by the walls 2 of the kiln, cooling sections 3 of broad width and noncooling sections 4 of narrow width are alternately provided as shown in FIG. 1, and cooling sections 3 are provided with a plurality of cooling nozzles 5. In this embodiment, strong cooling nozzles 5*a* blow out 1–2 $m^3$/min./nozzle of cooling gaseous fluid, for example, cooling air, while mild cooling nozzles 5*b* respectively facing the strong cooling nozzles blow out no more than 0.5 $m^3$/min./nozzle of cooling gaseous fluid, and these two kinds of nozzles are arranged alternately on both of the walls. Alternatively, all of the nozzles 5 on both walls may be strong cooling nozzles 5*a*, or only nozzles on one side in the first cooling section 3 and on the opposite in the second cooling section 3 are all strong cooling nozzles 5*a*, and so forth. Further, as is shown in FIG. 2, it is preferred to ensure uniform cooling by circulating the atmosphere in the cooling sections 3 with agitating ceiling fans 7 driven by motors 6.

Figure 3:
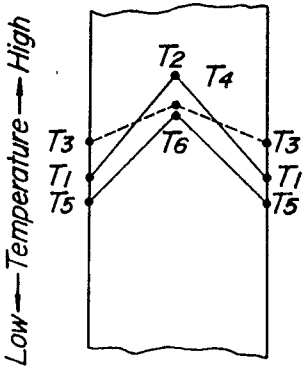
FIG. 3 is a diagram showing temperature gradients formed inside a fired product in the process of the present invention.

Now, after having been fired as carried on trucks 11 in a firing zone, hot fired products 10 such as tiles enter into the conjoined cooling zone shown in FIGS. 1 and 2, first into the cooling section 3, where they are cooled down by a cooling gaseous fluid such as air or the like blown from cooling nozzles 5. In this cooling step, a temperature gradient is formed between the surfaces and the inside of the fired product 10, as shown by solid lines $T_1T_2$ in FIG. 3. Next, fired products 10 move into the non-cooling section 4 and are subjected to a non-cooling step. In the non-cooling step, no cooling or only mild cooling takes place, so that heat moves from the centers of the fired products to the surfaces thereof whereby the temperature gradient within the products 10 is moderated or relaxed as shown by broken lines $T_3T_4$ in FIG. 3. Then, cooling is effected again in the subsequent cooling section 3, to form a temperature gradient as shown by solid lines $T_5T_6$ inside the fired products 10. The cooling may proceed with further alternate repetition of the cooling and non-cooling steps.

Thus, according to the present invention, since cooling is carried out intermittently to moderate the temperature gradient between the surfaces and the interior regions of the fired products 10, a rapid cooling or quenching which has been regarded as impossible due to dunting in conventional continuous cooling processes is performable. Further, it has heretofore taken, for example, about 5 hours to cool fired products at 1,200° C. coming out of the firing zone down to about 600° C. and, in contrast, the cooling can be completed in 2–3 hours according to the process of the invention. Consequently, the total length of a kiln such as a tunnel kiln can be shortened by no less than 5–10 m and the production efficiency of the kiln can be increased by about 10%.

Besides, in the embodiment shown in FIGS. 1 and 2, cooling sections 3 of broad width and non-cooling sections 4 of narrow width are defined and formed by and between both the walls 2 of the kiln so that fired products 10 can be subjected alternately to the cooling and non-cooling steps. However, such a width change of the cooling zone is not always necessary, but cooling sections 3 provided with cooling nozzles 5 and non-cooling zones 4 without cooling nozzles 5, both having the same width, may be formed alternately in a uniform width cooling zone. Alternatively, cooling nozzles 5 can be arranged along the entire length of the cooling zone, a part of which may be made either to stop or reduce the blowing gaseous fluid, to form non-cooling sections 4. However, if both strong cooling nozzles 5*a* and mild cooling nozzles 5*b* are provided in cooling sections 3 as shown in the embodiment so that strong cooling gaseous fluid may be impinged upon fired products 10 from the right and the left alternately with respect to the direction of travel of the fired products, the uniformity of cooling over the surfaces of fired products 10 is enhanced or simplified.

Further, in the case of a periodic kiln wherein fired products 10 are cooled while stationary, if a gaseous fluid blower is employed which is periodically variable in blown gaseous fluid quantity, the cooling step can be repeated alternately with the non-cooling step, similar to the case of the above embodiment.

As is clear from the above explanation, rapid cooling of fired products is enabled within a cooling time of as short as about half of that required in conventional processes without giving rise to dunting due to thermal stresses, by repeating two steps alternately in such a manner that, after cooling fired products in a cooling step, the temperature gradient formed between surfaces and the interior regions of the fired products is moderated in a subsequent non-cooling step, and then the fired products are subjected to another cooling step . According to the process of the invention, the tunnel kiln for firing, for example, tiles, therefore can be shortened and its productivity can be increased by 10% or more. As to periodic kilns, the productivity is also greatly improved. Accordingly, the present invention will largely contribute to the development of industry, as a process for cooling fired products in a kiln, which can overcome difficulties in conventional processes.

While there has been shown and described the preferred embodiments of the present invention, it will be obvious to those skilled in the art that various alterations and modifications thereof can be made without departing from the scope of the invention as defined by the following claims.

What is claimed is:

1. A process for cooling a fired product in a tunnel kiln having cooling nozzles, the process comprising intermittently blowing a cooling gaseous fluid onto a fired product by repeating a first cooling step comprising blowing a cooling gaseous fluid through said nozzles onto the fired product in the kiln, said first cooling step being perfored in cooling sections, followed by a second non-cooling step to moderate the temperature gradient in the fired product, the non-cooling step comprising stopping or reducing the blowing of the cooling gaseous fluid between cooling steps, said second cooling step being performed in non-cooling sections, a plurality of said cooling sections and a plurality of said non-cooling sections being alternately conjoined, a plurality of said cooling steps and a plurality of said non-cooling steps being performed by alternately repeating said first and second steps to cool said fired product at a rate of from about 200° C./hr to 300° C./hr.

2. A process as claimed in claim 1, wherein said cooling gaseous fluid contacts the product from the right and the left alternately.

* * * * *